US007913520B1

(12) United States Patent
Chen et al.

(10) Patent No.: US 7,913,520 B1
(45) Date of Patent: Mar. 29, 2011

(54) STRUCTURE OF SPACER FABRIC AND THICKNESS-CONTROLLED KNITTING METHOD FOR PRODUCING THE SAME

(75) Inventors: Shun-Chang Chen, Douliu (TW); Yu-Hui Wang, Douliu (TW)

(73) Assignee: Li Cheng Enterprise Co., Ltd, Yunlin County (TW)

( * ) Notice: Subject to any disclaimer, the term of this patent is extended or adjusted under 35 U.S.C. 154(b) by 0 days.

(21) Appl. No.: 12/690,156

(22) Filed: Jan. 20, 2010

(51) Int. Cl.
*D04B 9/06* (2006.01)

(52) U.S. Cl. ..... 66/196; 66/195

(58) Field of Classification Search ..... 66/196, 66/195, 202; 42/309, 310; 442/309, 310
See application file for complete search history.

(56) References Cited

U.S. PATENT DOCUMENTS

| | | | | | |
|---|---|---|---|---|---|
| 5,385,036 | A * | 1/1995 | Spillane et al. | ..... | 66/87 |
| 5,589,245 | A * | 12/1996 | Roell | ..... | 428/85 |
| 5,720,047 | A * | 2/1998 | Spitzer | ..... | 2/161.1 |
| 6,156,406 | A * | 12/2000 | Rock et al. | ..... | 428/86 |
| 6,755,052 | B1 * | 6/2004 | Sytz | ..... | 66/196 |
| 7,169,720 | B2 * | 1/2007 | Etchells et al. | ..... | 442/239 |
| 7,565,821 | B2 * | 7/2009 | Park et al. | ..... | 66/195 |

* cited by examiner

*Primary Examiner* — Danny Worrell
(74) *Attorney, Agent, or Firm* — Chun-Ming Shih

(57) ABSTRACT

In a structure of a spacer fabric and a thickness-controlled knitting method for producing the same are disclosed, the method includes knitting a yarn into a three laminated layer fabric, and the three laminated layer fabric includes a top layer, a middle layer and a bottom layer, wherein the middle layer has one end connected with the top layer and the other end connected with the bottom layer; and the spacer fabric has its thickness determined by a length and a knitted angle of the yarn of the middle layer; when in the knitting process, the length of each yarn of the middle layer is gradually decreased/increased and the knitted angle of each yarn of the middle layer is varied, thereby gradually increasing or decreasing the thickness of the spacer fabric.

4 Claims, 8 Drawing Sheets

STRUCTURE OF SPACER FABRIC AND THICKNESS-CONTROLLED KNITTING METHOD FOR PRODUCING THE SAME

BACKGROUND OF THE INVENTION

1. Field of the Invention

The present invention relates to a structure of a spacer fabric and a thickness-controlled knitting method for producing the same, and more particularly, to a structure of a spacer fabric and a thickness-controlled knitting method capable for knitting the spacer fabric having a varied thickness.

2. Description of the Prior Art

Traditionally, in order to produce a spacer fabric, a yarn is disposed in a knitting machine to be knitted into a spacer fabric having a upper fabric layer, a middle layer, and a lower fabric layer, wherein the middle layer is consisted of yarns each having one end connected with the upper fabric layer and the other end connected with the lower fabric layer, thereby forming a distance between the upper fabric layer and the lower fabric layer according to the length of the yarns of the middle layer. Using the thickness provided by the middle layer, the spacer fabric is widely applicable in shoe-pads, shoe materials, all kinds of pads and other products. However, due to the uniform thickness of the spacer fabric, when the spacer fabric is applied in a product requiring a varied thickness (such as a shoe-pad), the spacer fabric has to be processed additionally to form a fabric having a varied thickness.

Therefore, the prior art structure and knitting method still present some shortcomings to be overcome.

In view of the deficiencies of the prior art techniques, after years of constant researches, the inventor has successfully proposed a structure of a spacer fabric and a thickness-controlled knitting method of producing the same in the present invention.

SUMMARY OF THE INVENTION

It is an object of the present invention to provide a structure of a spacer fabric and a thickness-controlled knitting method of producing the same, when in the knitting process, the length of each yarn in the middle layer is gradually increased or decreased and the knitted angle of each yarn is varied to form a varied distance between the top layer and the bottom layer to let the spacer fabric be applied in products requiring varied thicknesses (such as shoe-pads).

In order to achieve the above object, a structure of a spacer fabric and a thickness-controlled knitting method for producing the same are provided, the method comprising disposing a yarn into a knitting machine and knitting the yarn into a three laminated layer fabric, the three laminated layer fabric comprising a top layer, a middle layer and a bottom layer, wherein the middle layer has one end connected with the top layer and the other end connected with the bottom layer; and the spacer fabric has its thickness determined by a length and a knitted angle of the yarn of the middle layer; when in the knitting process, the length of each yarn of the middle layer is gradually decreased/increased and the knitted angle of each yarn of the middle layer is varied, thereby gradually increasing or decreasing the thickness of the spacer fabric to push the top layer and the bottom layer away from the middle layer. Finally, the knitted spacer fabric is cut into a desired shape (such as a shoe-pad), then the cut spacer fabric is wrapped with a film completely with only an air inlet left for filling air through the air inlet to inflate the middle layer, the inflated middle layer having a height according to the length of the yarn so as to let the inflated spacer fabric have a varied thickness according to the length of the yarn, and then the air inlet is sealed to let the spacer fabric form an air cushion with a gradually decreasing or increasing or variable thickness.

These features and advantages of the present invention will be fully understood and appreciated from the following detailed description of the accompanying Drawings.

DETAILED DESCRIPTION OF THE PREFERRED EMBODIMENT

Figure 1:
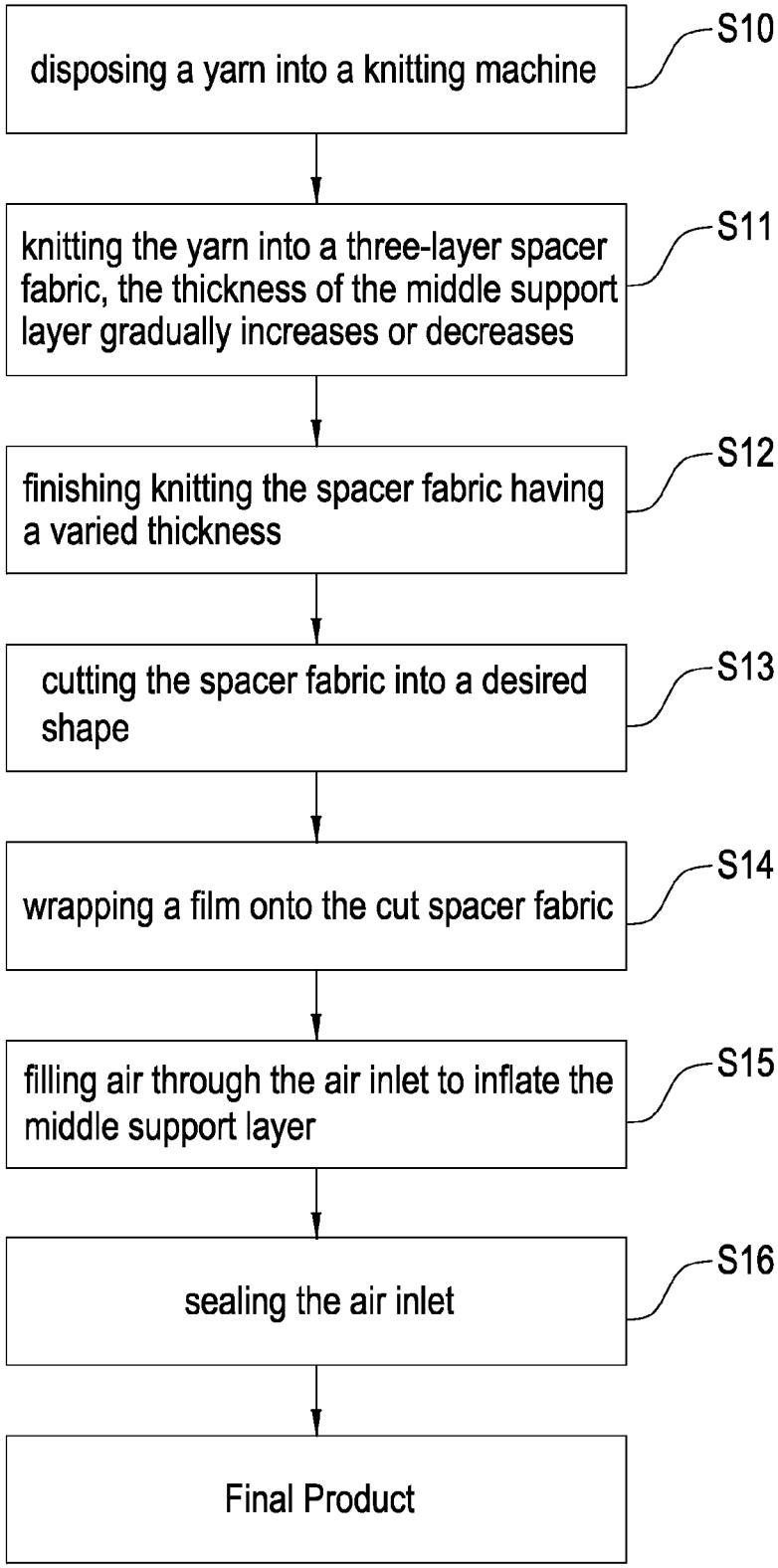
FIG. 1 illustrates a flowchart of a structure of a spacer fabric and a thickness-controlled knitting method for producing the same in the present invention.

Please refer to FIG. 1 for a flowchart of a structure of a spacer fabric and a thickness-controlled knitting method of producing the same in the present invention, wherein the method comprises:

S10: disposing a yarn into a knitting machine;

S11: knitting the yarn into the spacer fabric comprising a top layer, a middle layer and a bottom layer, wherein the middle layer has one end connected with the top layer and the other end connected with the bottom layer, the thickness of the middle layer equals to the distance between the top layer to the bottom layer; when in the knitting process, the length of the yarn of the middle layer is gradually decreased or increased and the knitted angle of the yarn of the middle layer is varied, thereby gradually increasing or decreasing the thickness of the spacer fabric; since the yarns of the middle layer are soft and cannot support the top layer and the top layer, when the top layer and the bottom layer are pushed away from the middle layer, the thickness of the middle layer will gradually increase or decrease or show irregular distribution due to different lengths of the yarns;

S12: after S11, finishing knitting the spacer fabric having a varied thickness;

S13: cutting the spacer fabric formed in step 12 into a desired shape;

S14: wrapping a film onto the cut spacer fabric to completely cover the cut spacer fabric with only an air inlet left;

S15: filling air through the air inlet to inflate the middle layer to let the middle layer support the top layer and the bottom layer, wherein the inflated middle layer has a height according to the length of each yarn so as to let the inflated spacer fabric have a varied thickness according to the length of each yarn; and S16: finally, sealing the air inlet to maintain the air inside the middle layer to let the spacer fabric form an air cushion.

Figure 2A:
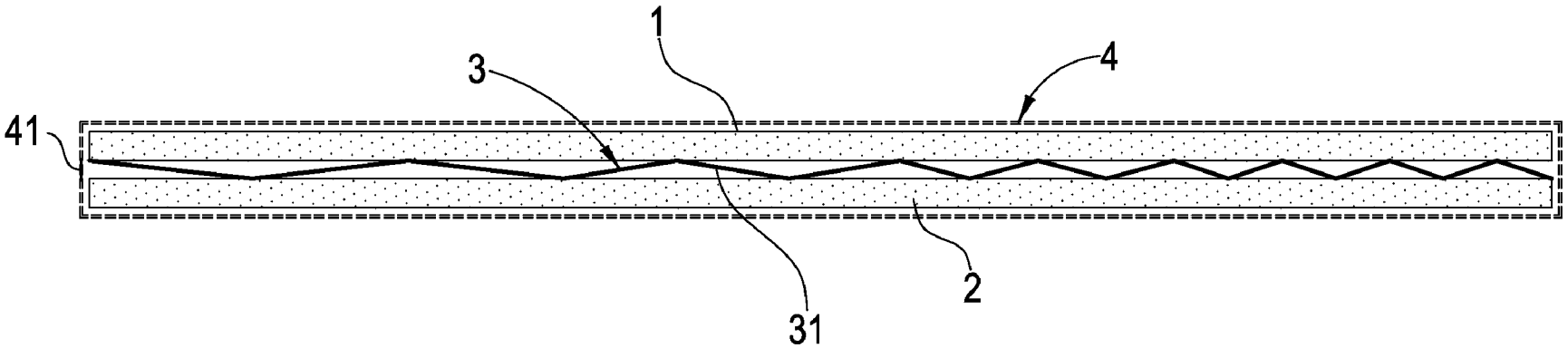
FIG. 2A and FIG. 2B illustrate a first embodiment of a structure of a spacer fabric and a thickness-controlled knitting method for producing the same in the present invention.
Figure 2B:
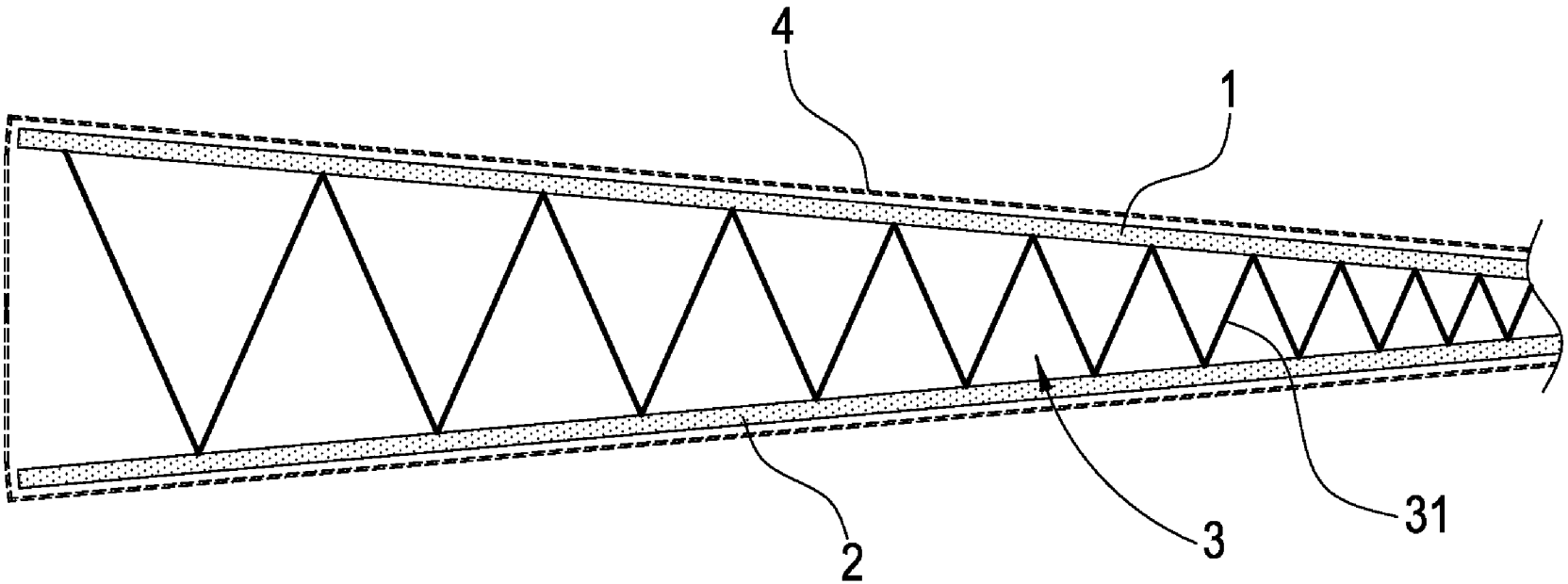
Figure 3:
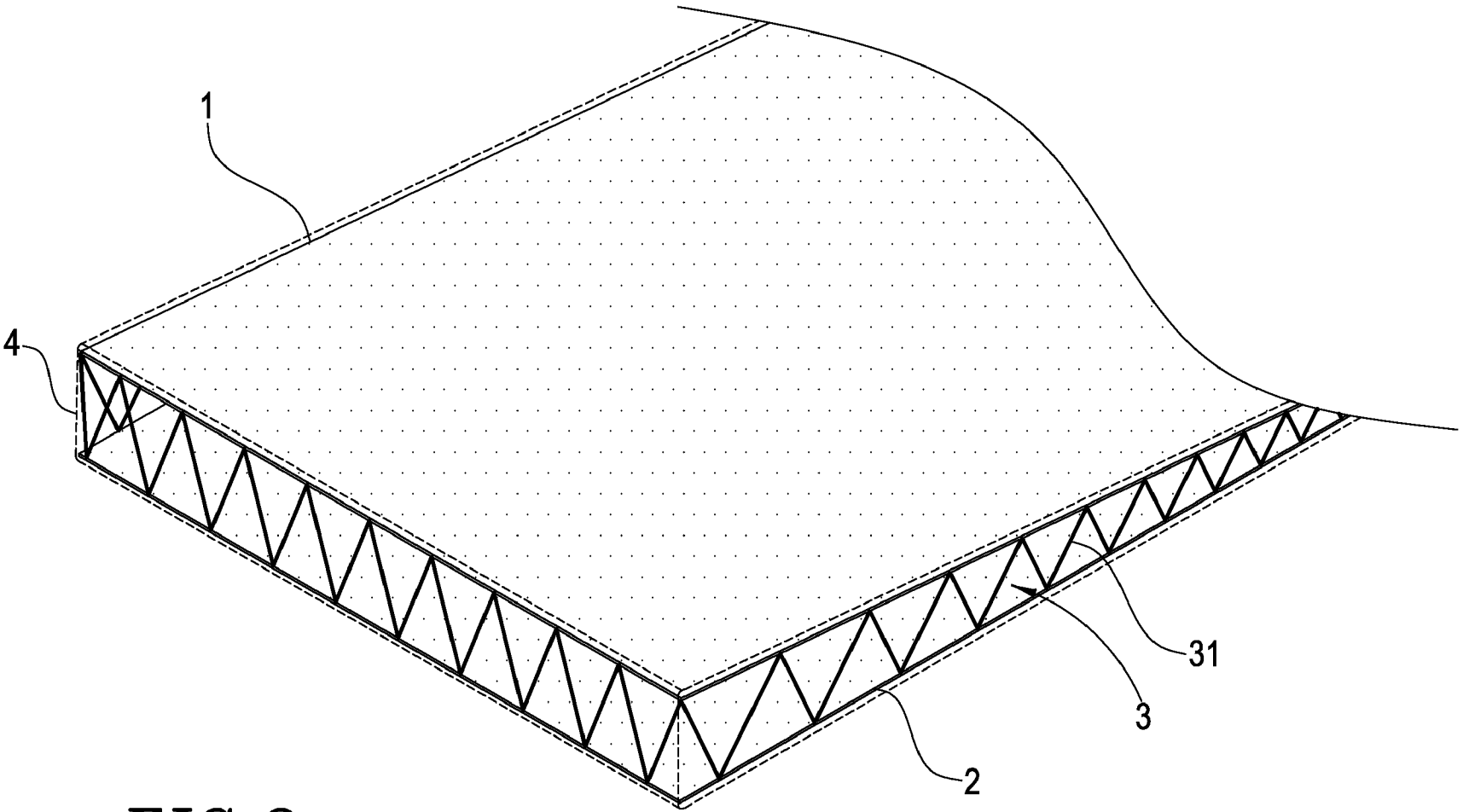
FIG. 3 illustrates a perspective view of the first embodiment of the structure of the spacer fabric and the thickness-controlled knitting method for producing the same in the present invention.

Please refer to FIG. 2A, FIG. 2B, and FIG. 3 for views of a first embodiment of a structure of a spacer fabric and a thickness-controlled knitting method of producing the same in the present invention, wherein the spacer fabric comprises:

a top layer 1 comprising a plurality of loop strings;

a bottom layer 2 comprising a plurality of loop strings;

a middle layer 3 having a plurality of vertical yarns 31 having different lengths and variable angles, each vertical yarn 31 having one end lapped with the top layer 1 and the other end lapped with the bottom layer 2, wherein a length and a knitted angle of each vertical yarn determine a distance between the top layer and the bottom layer;

a wrapping layer 4, wherein the wrapping layer 4 wraps the top layer 1, the bottom layer 2, and the middle layer 3 with only an air inlet 41 left for filling air to inflate the middle layer 3 to push the top layer 1 and the bottom layer 2 away from the middle layer 3; each vertical yarn 31 of the middle layer 3 determines an expanded distance between the top layer 1 and the bottom layer 2 so as to form a varied thickness between the top layer 1 and the bottom layer 2.

Furthermore, as shown in FIG. 2A, the vertical yarns 31 of the middle layer 3 are not rigid and cannot support the top layer 1 and the bottom layer 2, when the air is injected into the middle layer 3 to push the top layer 1 and the bottom layer 2 away from the middle layer 3, the length of each vertical yarn 31 of the middle layer 3 controls a thickness between the top layer 1 and the bottom layer 2.

Additionally, the lengths of the plurality of vertical yarns 31 of the middle layer 3 can gradually decrease or increase from one end of the middle layer 3 to the other end thereof to gradually decrease or increase the thickness between the top layer 1 and the bottom layer 2 so as to form a varied thickness between two ends of the spacer fabric.

Figure 4:
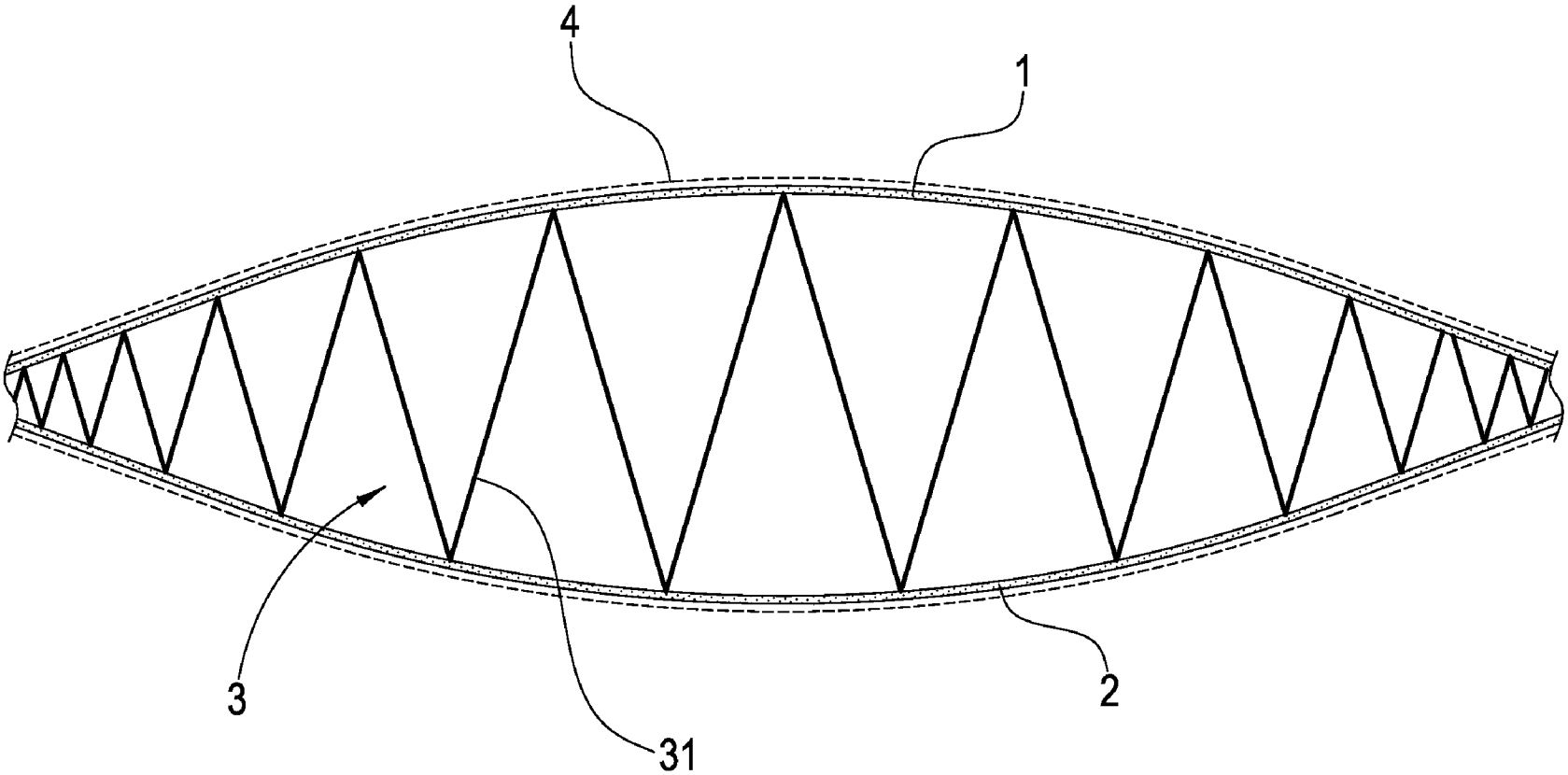
FIG. 4 illustrates a second embodiment of the structure of the spacer fabric and the thickness-controlled knitting method of producing the same in the present invention.

Please refer to FIG. 4 for a second embodiment of the present invention, what is different from FIG. 3 is that, the lengths of the plurality of vertical yarns 31 of the middle layer 3 gradually increase from one end of the middle layer 3 to the middle of the middle layer 3 and then gradually decrease from the middle of the middle layer 3 to the other end of the middle layer 3 to have a thickness in the middle of the middle layer 3 bigger than that at the both ends of the middle layer 3. The rest of the structure is the same as that in FIG. 3 and will not be further described for the sake of brevity.

Figure 5:
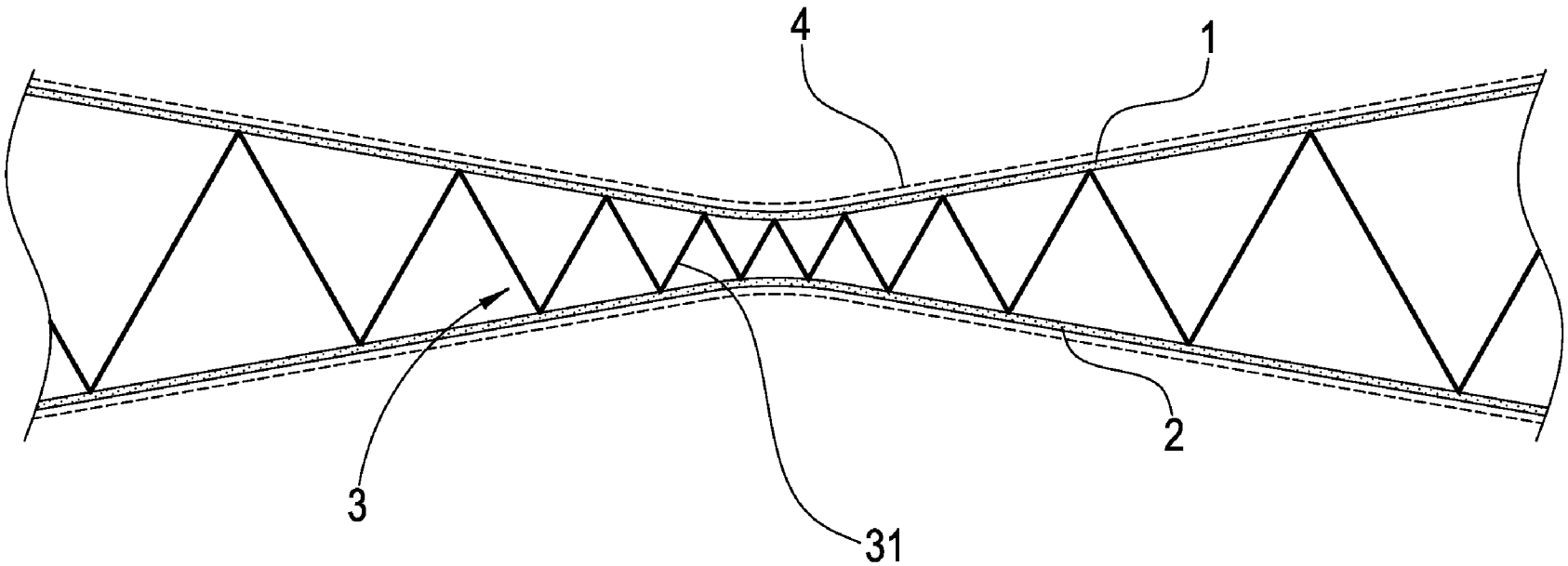
FIG. 5 illustrates a third embodiment of the structure of the spacer fabric and the thickness-controlled knitting method for producing the same in the present invention.

Please refer to FIG. 5 for a third embodiment of the present invention, what is different from FIG. 3 is that, the lengths of the plurality of vertical yarns 31 of the middle layer 3 gradually decrease from one end of the middle layer 3 to the middle of the middle layer 3 and then gradually increase from the middle of the middle layer 3 to the other end of the middle layer 3 to have a thickness in the middle of the middle layer 3 smaller than that at the both ends of the middle layer. The rest of the structure is the same as that in FIG. 3 and will not be further described for the sake of brevity.

Figure 6:
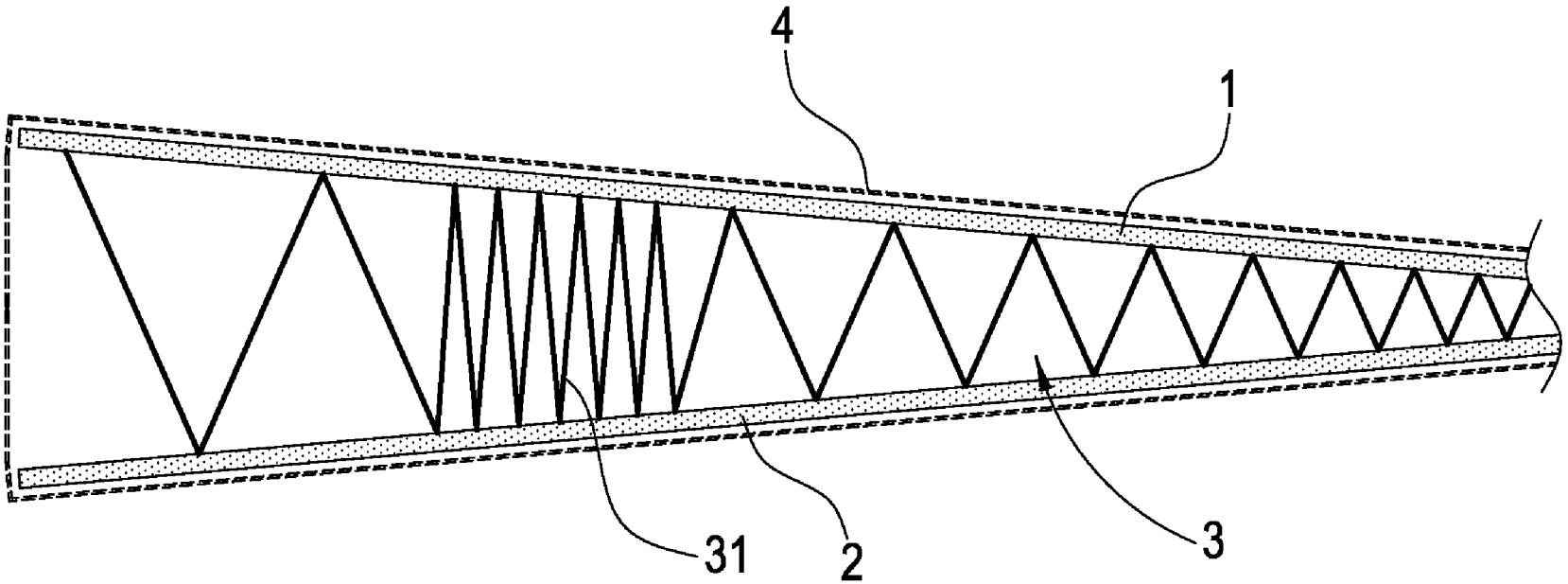
FIG. 6 illustrates a fourth embodiment of the structure of the spacer fabric and the thickness-controlled knitting method for producing the same in the present invention.

Please refer to FIG. 6 for a fourth embodiment of the present invention, what is different from FIG. 3 is that, the middle layer 3 has a plurality of vertical yarns 31 disposed at suitable positions to reinforce the structure at the positions. The rest of the structure is the same as that in FIG. 3 and will not be further described for the sake of brevity.

Figure 7:
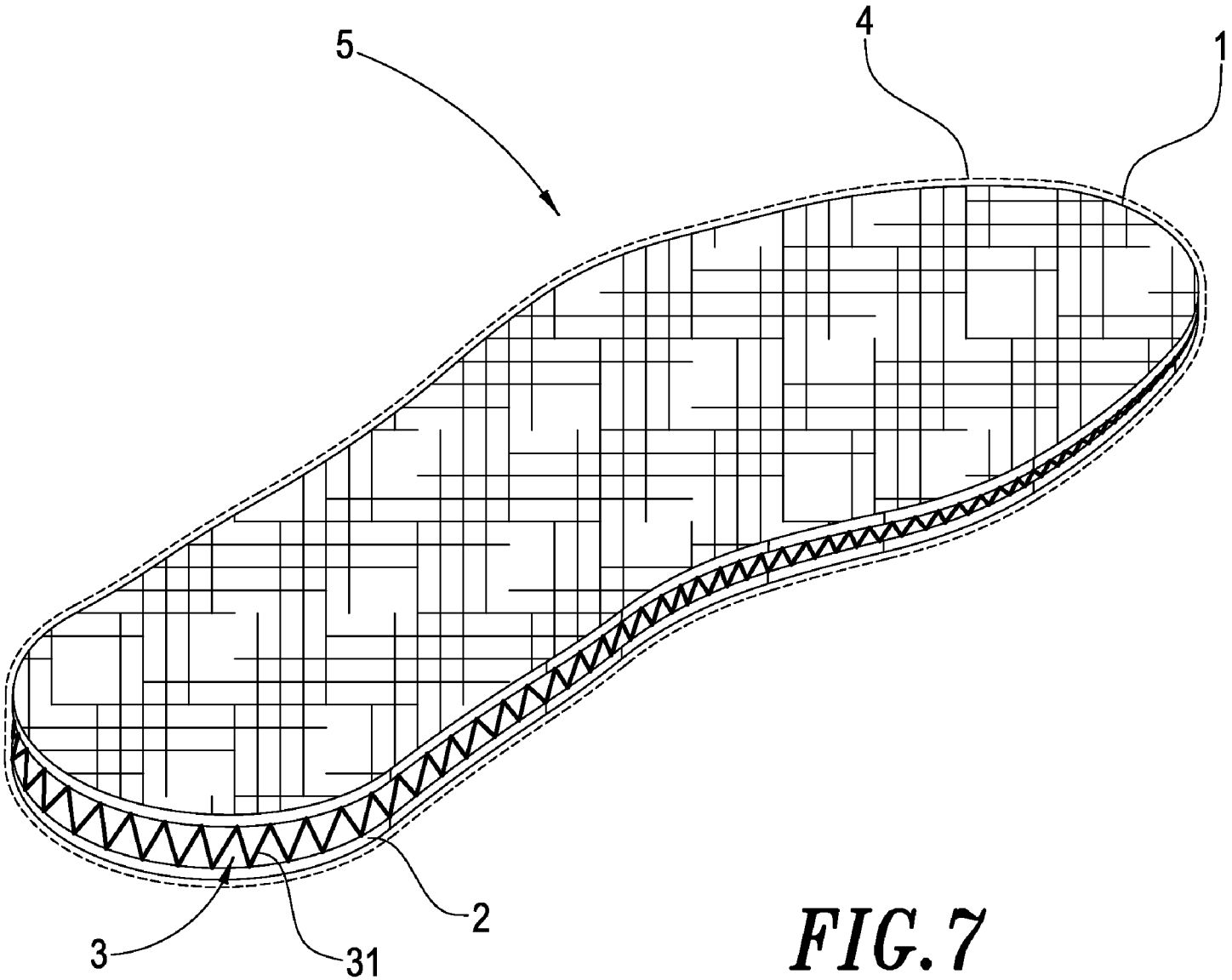
FIG. 7 illustrates an application view of the structure of the spacer fabric and the thickness-controlled knitting method for producing the same in the present invention.

FIG. 7 illustrates an application view of the present invention, the present invention is applicable in a shoe-pad 5 or other pads, take the shoe-pad 5 for example, the unwrapped spacer fabric is cut into a shape of a shoe-pad, then it is wrapped with a film, filled with air, and then sealed. It is observed that the thickness of the shoe-pad 5 gradually decreases from the shoe heel to the shoe heel toe, so the shoe-pad 5 is available without the need for further processing to save the labor time in producing the shoe-pad 5.

Therefore, by varying the length of each vertical yarn 31 of the middle layer 3, the distance between the top layer 1 and the bottom layer 2 at a specific position can be controlled; furthermore, it is possible to form a plurality of protrusions on the top layer 1 to let the spacer fabric be applied in products requiring varied thicknesses without additional processing.

The present invention discloses a structure of a spacer fabric and a thickness-controlled knitting method of producing the same, while compared to other prior art techniques, is advantageous in:

During the knitting process, the length of the yarns of the middle layer is gradually decreased/increased and the knitted angle of the yarns of the middle layer is varied, thereby gradually increasing or decreasing the thickness between the top layer and the bottom layer to let the spacer fabric be applied in products requiring varied thicknesses.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A structure of a spacer fabric, comprising:

a top layer comprising a plurality of loop strings;

a bottom layer comprising a plurality of loop strings;

a middle layer having a plurality of vertical yarns having different lengths and variable angles, each vertical yarn having one end lapped with the top layer and the other end lapped with the bottom layer, wherein a length of each vertical yarn equals to a distance between the top layer and the bottom layer, wherein the lengths of the plurality of vertical yarns gradually increase from one end of the middle layer to the middle of the middle layer and then gradually decrease from the middle of the middle layer to the other end of the middle layer to have a thickness in the middle of the middle layer bigger than that at the both ends of the middle layer, the middle layer has a plurality of vertical yarns disposed at suitable positions to reinforce the structure at the positions.

2. The structure of the spacer fabric as claimed in claim 1 further comprising a wrapping layer, wherein the wrapping layer wraps the top layer, the bottom layer, and the middle layer with only an air inlet left for filling air to inflate the middle layer to push the top layer and the bottom layer away from the middle layer; each vertical yarn determines an expanded distance between the top layer and the bottom layer so as to form a varied thickness between the top layer and the bottom layer.

3. The structure of the spacer fabric as claimed in claim 1, wherein the vertical yarns of the middle layer are not rigid and cannot support the top layer and the bottom layer, when the top layer and the bottom layer are pushed away from the middle layer, the length of each vertical yarn of the middle layer equals to a thickness between the top layer and the bottom layer.

4. A structure of a spacer fabric, comprising:

a top layer comprising a plurality of loop strings;

a bottom layer comprising a plurality of loop strings;

a middle layer having a plurality of vertical yarns having different lengths and variable angles, each vertical yarn having one end lapped with the top layer and the other end lapped with the bottom layer, wherein a length of each vertical yarn equals to a distance between the top layer and the bottom layer, wherein the lengths of the plurality of vertical yarns gradually decrease from one end of the middle layer to the middle of the middle layer and then gradually increase from the middle of the middle layer to the other end of the middle layer to have a thickness in the middle of the middle layer smaller than that at the both ends of the middle layer.

* * * * *